United States Patent [19]

Rouillard

[11] Patent Number: 5,064,561

[45] Date of Patent: Nov. 12, 1991

[54] TWO-PART CLEAN-IN-PLACE SYSTEM

[75] Inventor: Carol Rouillard, Taylor, Mich.

[73] Assignee: Diversey Corporation, Mississauga, Canada

[21] Appl. No.: 520,887

[22] Filed: May 9, 1990

[51] Int. Cl.[5] ..... C11D 3/386; C11D 17/00

[52] U.S. Cl. ..... 252/174.12; 252/90; 252/135; 252/156; 252/174; 252/174.16; 252/174.21; 252/174.24; 252/527; 252/546; 252/DIG. 11; 252/DIG. 12; 252/DIG. 14

[58] Field of Search ..... 252/174.12, DIG. 12, 252/156, DIG. 11, DIG. 14, 174, 90, 174.21, 174.24, 174.16, 135, 527, 546

[56] References Cited

U.S. PATENT DOCUMENTS

| | | | |
|---|---|---|---|
| 2,333,689 | 1/1944 | Parker et al. | 252/174.12 |
| 3,472,783 | 10/1969 | Smillie | 252/174.12 |
| 4,081,395 | 3/1978 | Talley | 252/106 |
| 4,169,817 | 10/1979 | Weber | 252/545 |
| 4,212,761 | 7/1980 | Ciaccio | 252/174.12 |
| 4,243,543 | 1/1981 | Guilbert | 252/105 |
| 4,624,803 | 11/1986 | Balzer et al. | 252/527 |
| 4,844,744 | 7/1989 | Leiter et al. | 134/40 |
| 4,935,065 | 6/1990 | Bull | 134/22.13 |

*Primary Examiner*—Paul Lieberman
*Assistant Examiner*—A. Beadles-Hay
*Attorney, Agent, or Firm*—Weintraub, DuRoss & Brady

[57] ABSTRACT

A two-part cleaning system for use in clean-in-place applications such as dairy processing facilities and breweries includes a first concentrate solution and a second concentrated solution. The first concentrated solution includes an alkaline material, a defoamer, a solubilizer or emulsifier, water as a solvent, and a water hardness control additive, while the second concentrated solution includes an enzyme which is a protease.

6 Claims, No Drawings

TWO-PART CLEAN-IN-PLACE SYSTEM

BACKGROUND OF THE INVENTION

1. Field of the Invention

The present invention relates to a cleaning system and method for use in clean-in-place (CIP) operations, such as, e.g., dairy processing facilities. More particularly, the present invention relates to a system and method involving a two-part cleaning composition concentrate, in which a first concentrated solution comprises an alkaline material, and a second concentrated solution comprises an enzyme.

2. Prior Art

Many commercial products are available today for use in clean-in-place industrial applications such as, e.g., dairy processing facilities, beverage processing facilities, or breweries. Traditional alkaline cleaner use solutions generally include chlorine and a highly alkaline material and normally have an approximate pH of 12.

Many of the conventional cleaning products available today, for use in clean-in-place applications, include chlorine. Some concerns have arisen, regarding the use of chlorine, for environmental reasons. For example, the chlorine may combine with organic compounds to create chlorinated organic compounds which may pose long term health risks. Accordingly, there is a need for effective cleaning compositions for use in clean-in-place systems, which do not require the inclusion of chlorine.

Heretofore, the use of alkaline proteases in cleaning compositions has been proposed in the prior art, and a summary of some patents which teach the use of proteases in cleaning compositions follows.

Jones et al, U.S. Pat. No. 3,790,482 teaches the use of a combination of an alkaline protease and an amylase in a dry granular laundry detergent composition. The composition of Jones et al includes an organic detergent, an alkaline builder salt, an alkaline protease, and an amylase and is generally used for laundering of fabrics.

Weber, U.S. Pat. No. 4,169,817 discloses a liquid cleaning composition containing a detergent builder, a surfactant, an alkaline protease, and an enzyme stabilizing agent which is a water soluble salt and/or a water soluble hydroxy alcohol. The composition of Weber may be used in a laundry presoak solution, as a laundry detergent, or may be used as a general purpose cleaner to clean processing equipment in the dairy and cheese-making industries. The detergent solution of Weber generally has a pH in the range of 7.0 to 11.0.

Guilbert et al, U.S. Pat. No. 4,243,543 discloses a liquid detergent composition containing a protease which is stabilized by a stabilizing system which includes a reducing agent, a polyol, and a buffering agent. In one embodiment, Guilbert teaches a two-part cleaning composition for clean-in-place applications, in which a first part includes the enzyme, a detergent, and the stabilizing system; while a second, alkaline part includes a chelating agent. The pH of the use solution in this example of Guilbert is 11–12.

Although alkaline cleaning compositions which use preoteolytic enzymes have been proposed in the prior art for clean-in-place applications, the prior art compositions require relatively complicated enzyme stabilizing systems due to the number of additives in solution with the enzyme. Therefore, a simplified system in which the enzyme is storage stabilized without the expense and complexity of the prior art systems would be advantageous and economical as compared to the prior art.

SUMMARY OF THE INVENTION

The present invention provides a two-part cleaning system and method for use in clean-in-place (CIP) facilities, which does not require the use of chlorine.

A cleaning system in accordance with the present invention, is derived from a two part concentrate, which, comprises:

(a) a first concentrated solution, comprising:
  (1) a highly alkaline material;
  (2) a defoamer;
  (3) a solubilizer or emulsifier;
  (4) a water hardness control additive;
  (5) water; and (b) a second concentrated solution, comprising an enzyme which is a protease.

A use solution is prepared by admixing the concentrates with water such that the first concentrate is present in an amount ranging from about 2.0 to about 10.0 parts per thousand, and the second concentrate is present in an amount from about 5.0 to 1000 ppm. The use solution, generally has a pH of from about pH 9.5 to about pH 10.5.

For a more complete understanding of the present invention, reference is made to the following detailed description and to the examples contained therein.

DETAILED DESCRIPTION OF THE PREFERRED EMBODIMENTS

It has been discovered, in accordance with the practice of the present invention, that a use solution prepared from a two-part concentrated cleaning system, which includes a first part having an alkaline component and a second part which includes an enzyme which is a protease, provides results which are equal to or better than those obtained with conventional highly alkaline cleaners having chlorine therein. In addition, it has been discovered that when employing a two-part system for preparing a use solution, a complicated enzyme stabilizing system such as that suggested in the prior art is not required, if the bulk of the additives are mixed with the alkaline solution instead of with the enzyme containing solution.

The two-part system of the present invention, generally, comprises:

(a) a first concentrated solution, comprising:
  (1) an alkaline material;
  (2) a defoamer;
  (3) a solubilizer or emulsifier;
  (4) a water hardness control additive; and
  (5) water; and (b) a second concentrated solution, comprising an enzyme which is a protease.

The alkaline material is present in the first concentrated solution in a range from about 2.5 to 7.5 by weight, based on the total weight of the first concentrated solution, and preferably from about 3 to about 4%, by weight based on the total weight of the first concentrated solution.

Useful alkaline materials include, for example, sodium hydroxide, potassium hydroxide, and the like, as well as mixtures thereof.

Ordinarily, the alkaline material, is employed as an aqueous solution thereof such as a 50% aqueous solution NaOH or a 45% aqueous solution of potassium hydroxide. The amounts set out herein are percentages of the active compound. Both NaOH and KOH are suitable for use in the practice of the present invention.

The defoamer used herein may be a nonionic surfactant, such as a polyoxypropylene-polyoxyethylene block copolymer.

The nonionic surfactants which are advantageously employed in the compositions of the present invention are basically the polyoxyalkylene adducts of hydrophobic bases wherein the oxygen/carbon atom ratio in the oxyalkylene portion of the molecule is greater than 0.40. Those compositions which are condensed with hydrophobic bases to provide a polyoxyalkylene portion having an oxygen/carbon atom ratio greater than 0.40 include ethylene oxide, butadiene dioxide and glycidol, mixtures of these alkylene oxides with each other and with minor amounts of propylene oxide, butylene oxide, amylene oxide, styrene oxide, and other higher molecular weight alkylene oxides. Ethylene oxide, for example, is condensed with the hydrophobic base in an amount sufficient to impart water dispersibility or solubility and surface active properties to the molecule being prepared. The exact amount of ethylene oxide condensed with the hydrophobic base will depend upon the chemical characteristics of the base employed and is readily apparent to those of ordinary skill in the art relating to the synthesis of oxyalkylene surfactant condensates. Typical hydrophobic bases which can be condensed with ethylene oxide in order to prepare nonionic surface active agents include mono-and polyalkylphenols, polyoxypropylene condensed with a base having from about 1 to 6 carbon atoms and at least one reactive hydrogen atom, fatty acids, fatty amines, fatty amides and fatty alcohols. The hydrocarbon ethers such as the benzyl or lower alkyl ether of the polyoxyethylene surfactant condensates are also advantageously employed in the compositions of the invention.

Among the suitable nonionic surface active agents are the polyoxyethylene condensates of alkylphenols having from about 6 to 20 carbon atoms in the alkyl portion and from about 5 to 15 ethenoxy groups in the polyoxyethylene radical. The alkyl substituent on the aromatic nucleus may be octyl, diamyl, n-dodecyl, polymerized propylene such as propylene tetramer and trimer, isoctyl, nonyl, etc. The benzyl ethers of the polyoxyethylene condensates of monoalkyl phenols impart good properties to the compositions of the invention. A typical product corresponds to the formula:

$$C_{18}H_{17}—O—(OCH_2CH_2)_{15}OCH_2C_6H_5$$

Higher polyalkyloxyethylated phenols corresponding to the formula:

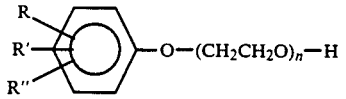

wherein R is hydrogen or an alkyl radical having from about 1 to 12 carbon atoms, R' and R'' are alkyl radicals having from about 6 to 16 carbon atoms and n has a value from about 10 to 40, are also suitable as nonionic surfactants. A typical oxyethylated polyalkylphenol is dinonylphenol condensed with 14 moles of ethylene oxide.

Other suitable nonionic surface active agents are cogeneric mixtures of conjugated polyoxyalkylene compounds containing in their structure at least one hydrophobic oxyalkylene chain in which the oxygen/carbon atom ratio does not exceed 0.40 and at least one hydrophilic oxyalkylene chain in which the oxygen/carbon atom ratio is greater than 0.40.

Polymers of oxyalkylene groups obtained from propylene oxide, butylene oxide, amylene oxide, styrene oxide, mixtures of such oxyalkylene groups with each other and with minor amounts of polyoxyalkylene groups obtained from ethylene oxide, butadiene dioxide, and glycidol are illustrative of hydrophobic oxyalkylene chains having an oxygen/carbon atom ratio not exceeding 0.40. Polymers of oxyalkylene groups obtained from ethylene oxide, butadiene dioxide, glycidol, mixtures of such oxyalkylene groups with each other and with minor amounts of oxyalkylene groups obtained from propylene oxide, butylene oxide, amylene oxide, and styrene oxide are illustrative of hydrophilic oxyalkylene chains having an oxygen/carbon atom ratio greater than 0.40.

Further suitable nonionic surface active agents are the polyoxyethylene esters of higher fatty acids having from about 8 to 22 carbon atoms in the acyl group and from 8 to 15 ethanoxy units in the oxyethylene portion. Typical products are the polyoxyethylene adducts of tall oil, rosin acids, lauric, stearic and oleic acids and the like. Additional, nonionic surface active agents are the polyoxyethylene condensates of higher fatty acid amines and amides having from about 8 to 22 carbon atoms in the fatty alkyl or acyl group and about 10 to 15 ethanoxy units in the oxyethylene portion. Illustrative products are coconut oil, fatty acid amines and amides condensed with about 10 to 15 moles of ethylene oxide.

Other suitable polyoxyalkylene nonionic surface active agents are the alkalene oxide adducts of higher aliphatic alcohols and thioalcohols having from about 8 to 22 carbon atoms in the aliphatic portion and about 3 to 15 carbon atoms in the oxyalkylene portion. Typical products are the synthetic fatty alcohols, such as n-decyl, n-undecyl, n-dodecyl, n-tridecyl, n-tetradecyl, n-hexadecyl, n-octdadecyl and mixtures thereof condensed with 3 to 15 moles of ethylene oxide, a mixture of normal fatty alcohols condensed with 9 to 20 moles of ethylene oxide and capped with a benzyl group, an alkyl group, a mixture of normal fatty alcohols condensed with 10 to 30 moles of a mixture of ethylene and propylene oxides, a mixture of several fatty alcohols condensed sequentially with 2 to 20 moles of ethylene oxide and 3 to 10 moles of propylene oxide, in either order; or a mixture of normal fatty alcohols condensed with a mixture of propylene and ethylene oxides, in which the oxygen/carbon atom ratio is less than 0.40 followed by a mixture of propylene and ethylene oxides in which the oxygen/carbon atom ratio is greater than 0.40 or a linear secondary alcohol condensed with 3 to 10 moles of ethylene oxide, or a linear secondary alcohol condensed with a mixture of propylene and ethylene oxides, or a linear secondary alcohol condensed with a mixture of ethylene, propylene and higher alkylene oxides.

One commercially available product which is suitable as a defoamer is a polyoxypropylene-polyoxyethylene block copolymer nonionic surfactant sold by BASF Corporation under the name INDUSTROL N-3.

The defoamer is present in the first concentrated solution in a range from about 0.5 to about 5%, by weight, based on the total weight of the first concentrated solution, and preferably from about 1 to about 2%, by weight, based on the total weight of the first concentrated solution.

It should be noted that the defoamer may not always be required if a liquid form of the enzyme is used in the second concentrated solution.

A solubilizer or emulsifier may be required to disperse the defoamer in aqueous media. Suitable solubilizers for use in the present invention include, e.g., alkaline stable amphoteric surfactants, phosphate esters, fatty acids and the modified polycarboxylate compounds described in patent application Ser. No. 07/078,893, the disclosure of which is hereby incorporated by reference. Mixtures of the above solubilizers and/or emulsifiers may also be used.

Suitable fatty acids include those having from 8–12 carbon atoms. Suitable phosphate esters include, e.g., potassium salts of alkyl or aryl ethoxylate phosphate esters and phosphate esters of polyoxyalkylated fatty alcohols, which may be alkoxylated in a manner analogous to that described above for nonionic surfactants. Suitable amphoteric surfactants include, e.g., substituted carboxylated cocoimidazoline organophosphates. Amphoteric detergents include the higher fatty carboxylates, phosphates, sulfates or sulfonates which contain a cationic substituent such as an amino group, which may be quaternized, e.g., with a lower alkyl group, or chain extended at the amino group by condensation with a lower alkylene oxide, e.g., ethylene oxide. Examples of suitable amphoteric detergents include alkyl beta-amino dipropionates, $RN(C_2H_2COOM)_2$; alkyl beta-amino propionates, $RN(H)C_2H_4COOM$; and long chain imidazole derivatives having the general formula:

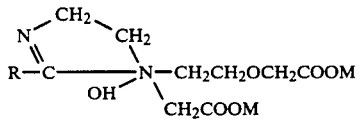

wherein in each of the above formulae R is an acyclic hydrophobic group containing from about 8 to 18 carbon atoms and M is a cation to neutralize the charge of the anion.

The preferred solubilizer is an amphoteric surfactant, and in particular, the isodecyloxypropylaminodipropionic acid surfactant which is marketed by Exxon under the mark "TOMAH ALKALI SURFACTANT". The solubilizer or emulsifier is present in the first concentrated solution in a range from about 1 to about 6%, by weight, based on the total weight of the first concentrated solution, and preferably from about 3 to about 4%, by weight, based on the total weight of the first concentrated solution.

The first concentrated solution of the present invention should, preferably, also include a sequestrant or chelant for water hardness control, for trapping hard-water ions, such as calcium or magnesium ions, and for promoting anti-redeposition of soils. Suitable water hardness control additives include phosphates, such as sodium tripolyphosphate, complex phosphates, the sodium salt of ethylene diamine tetracetic acid (EDTA), polyacrylic acids, such as those having a molecular weight of 3000 to 6000, and mixtures of polyacrylic acid and salts thereof having a molecular weight of 3000 to 6000. The preferred sequestrant is a polyacrylic acid.

One commercially available polyacrylate solution, which is suitable for use as a water hardness control additive in the practice of the present invention, is a mixture of 48% polyacrylic acid having an average molecular weight of 4500 sold by Rohm and Haas Company under the tradename "ACRYSOL LMW 45".

The first concentrated solution also contains water as a solvent in an amount generally ranging from about 65 to about 95%, by weight, based on the total weight of the first concentrated solution. Generally, the water is added in an amount sufficient to render 100%, when the other components are added in the ranges specified. The water is preferably added in an amount ranging from about 65 to about 92.5%, by weight, based on the total weight of the first concentrated solution. The water hardness control additive is present in the first concentrated solution in a range from about 0 to about 16%, by weight, based on the total weight of the first concentrated solution, and preferably from about 0.5 to about 8%, by weight, based on the total weight of the first concentrated solution.

Any sequestering agent which will complex calcium and magnesium ions from water may be employed in the practice of the present invention. Additional soluble sequestering agents include trans-1,2 diamino cyclohexane tetracetic acid monohydrate, diethylene triamine pentacetic acid, sodium salt of nitrilo triacetic acid, pentasodium salt of N-hydroxyethylene diamine triacetic acid, trisdoium salt of N,N-di(beta-hydroxyethyl)glycine, and sodium salt of a glucoheptonate.

The first concentrated solution may also include other optional ingredients. Some additional ingredients which may be used as components of the first concentrated solution are buffers and fatty acids.

Buffers such as, e.g., $Na_2CO_3$ may be used to stabilize the pH of the composition. When used, buffers may be present in the first concentrated solution in an amount ranging from about 2% to about 10% by weight of the total weight of the first concentrated solution.

Fatty acids having from about 8 to 12 carbon atoms are preferred. Mixtures of fatty acids may also be used. A particularly preferred fatty acid composition is a mixture of capric and caprylic acids sold commercially by Emery under the trade name "EMERY 6358". When present, the fatty acid component is present in the first concentrated solution in an amount ranging from about 1% to about 10%, by weight, based on the total weight of the first concentrated solution, and preferably in an amount ranging from about 1% to about 5% by weight, based on the total weight of the first concentrated solution.

The first concentrated solution is prepared by mixing the components together at ambient conditions, i.e., approximately 1 atm pressure and 25° C.

In the practice of the present invention, the enzyme is preferably added in a separate solution from most of the other components to promote stability in storage and to ensure efficacy of the enzyme in the use solution when the concentrated solutions hereof are mixed and diluted. The second concentrated solution is generally a liquid or slurry of enzyme in a carrier, which is ordinarily an alcohol, a surfactant, a polyol, or mixtures thereof. This material can be either ethylene glycol, propylene glycol, glycerol, or a sucrose-based polyol as well as mixtures thereof.

It is believed that the practice of keeping the enzyme in a solution which does not contain water prolongs stability of the enzyme, since free water has a tendency to degrade enzymes.

In preparing the use solution, the enzyme is preferably present in a concentration of about 10 ppm to about 300 ppm, and preferably from about 15 ppm to about 200 ppm by weight based on the total weight of the second concentrated solution. Proteases are preferred enzymes in the practice of the present invention. One suitable commercial product which has been found useful as a source of enzyme in the practice hereof, is that sold commercially by Novo Laboratories under the name "ESPERASE". This is available in a liquid form or in a slurry called "ESPERASE 8.0 SL" which includes a proteolytic enzyme suspended in a surfactant (TERGITOL 15-S-9 polyethoxylated secondary fatty alcohol from Union Carbide).

As noted, the first and second concentrates are employed to make a use solution therefrom. The use solution, is ordinarily, an aqueous use solution.

The use solution according to the practice of the present invention, is employed by circulating it through industrial equipment such as, e.g., dairy or beverage processing equipment, to clean the equipment in place. The use solution is prepared by adding the first concentrated solution in an amount sufficient to provide from about 0.2 to about 1.0% by weight of the total weight of the use solution, to water at ambient conditions. The second concentrated solution is then added in an amount sufficient to provide from about 5.0 parts per million to about 200 parts per million, by weight, of the use solution. After thorough mixing, the use solution is then circulated through the equipment to be cleaned.

It has been observed that using the dilute use solution hereof, at 60°-65° C., 100% enzyme activity is retained after 2 hours.

An additional advantage of the use solution hereof, as compared to conventional alkaline CIP cleaning solutions, is that the use solution of the present invention is less alkaline than use solutions of conventional cleaners. For example, while a 0.4% use solution of most conventional cleaners has a pH of 11-12, a use solution containing 0.4% of the cleaner hereof has a pH of about 9.5 to about 10.5 and, preferably, from about 9.8 to about 10.2. The standard of pH is not always a good measure of the alkalinity of a solution, since it will not reflect a buffered solution. Thus, as compared to an aqueous solution of $Na_2OH$, while a 0.4% aqueous solution of a conventional chlorinated cleaner has an alkalinity equivalent to a 0.06% solution of $Na_2OH$, a 0.4% aqueous solution of the cleaner hereof has an alkalinity equivalent to a 0.01% solution of $Na_2OH$. This solution, with its lowered alkalinity, is considerably less harsh on the environment, or in a water treatment plant, than the prior art solutions.

For a more complete understanding of the present invention, reference is made to the following examples. The examples contained herein are intended to be illustrative, and not limitative. Many modifications of the present invention will occur to those skilled in the art. All such modifications which fall within the scope of the appended claims are intended to be within the scope and spirit of the present invention. In the examples, all parts are to be construed as by weight, absent indications to the contrary.

EXAMPLES 1-4

These examples illustrate the preparation of the first concentrated solution in accordance with the present invention.

A series of five cleaning compositions was prepared by mixing together the ingredients in the order listed, at ambient conditions (25° C. at 1 atm pressure), each including sodium or potassium hydroxide, water, and a chelating agent. Some of the compositions further include a defoamer and a solubilizer to solubilize the defoamer. The following table, Table 1, lists the components used to formulate the experimental cleaning compositions, and the percentages of components used therein.

TABLE 1

| | FORMULAS | | | | |
|---|---|---|---|---|---|
| Raw Material | Cleaner 1 | Cleaner 2 | Cleaner 3 | Cleaner 4 | Cleaner 5 |
| $H_2O$ | 81.0 | 79.8 | 80.5 | 84.0 | 80.75 |
| 1st Solubilizer[1] | 2.0 | 3.0 | 2.5 | — | — |
| First Defoamer[2] | 1.0 | 1.2 | 1.0 | — | 0.75 |
| KOH, 45% aqueous solution | 8.0 | 8.0 | 8.0 | — | — |
| 1st Chelant[3] | 8.0 | 8.0 | 8.0 | 10.5 | 8.0 |
| NaOH, 50% aqueous solution | — | — | — | 5.0 | 6.0 |
| Soda Ash[4] ($Na_2CO_3$) | — | — | — | 1.0 | — |
| 2nd Defoamer | | | | | 1.00 |
| Fatty Acid[6] (2nd Solubilizer) | | | | | 3.00 |
| 2nd Chelant[7] | | | | | 0.50 |

[1]Isodecyloxypropylaminodipropionic acid amphoteric surfactant sold by Exxon under the name "TOMAH ALKALI SURFACTANT".
[2]A polyoxypropylene polyoxyethylene block copolymer sold by BASF Corp. as INDUSTROL N-3.
[3]48% polyacrylic acid with an active molecular weight of 4500 sold by Rohm and Haas Co. under the name "ACRYSOL LMW-45".
[4]Soda Ash is included as a buffer.
[5]A polypropxylate sold by BASF as "Degressal SD 20".
[6]A mixture of capric and caprylic acids sold by Emery as "Emery 6358".
[7]A phosphonate sequestrant sold by Monsanto as "DEQUEST 2000".

EXAMPLES 5-11

A series of tests were performed to compare the performance of the cleaners of Table 1, both with and without a proteolytic enzyme component, to a standard chlorinated cleaner.

A series of 3'×6' stainless steel panels (3042b finish) were degreased with a hot chlorinated alkaline solution. The panels were then thoroughly cleaned by hand, by scrubbing with a sponge and cleaning solution. When the panels were completely cleaned, they displayed a consistent pattern, when rinse water was allowed to flow off the surface thereof, in that a clean surface was presented and no breaks in the "sheeting" of the rinse water were observed. The panels were then suspended from a metal rod and soiled by immersing them in a trough of cold milk (8° to 12° C.) for ten minutes. The milk used was pasteurized whole milk. The panels were then thoroughly rinsed. The panels were then suspended for an additional ten minutes in cleaning solutions, which had been prepared as dilute solutions containing 0.4% of each the concentrate solutions from Table 1, mixed with sufficient ESPERASE 8.0 SL enzyme slurry to provide 20 ppm of the slurry in the cleaning solution. The entire soil/rinse/clean procedure, as described, was repeated for a total of 10 cycles thereof. Some of the tests were performed without adding the enzyme, as indicated, in Table 2, and in one test, a 20 ppm aqueous solution of the enzyme slurry was evaluated alone. The cleaning solutions were maintained at 140° F. (60° C.). The pattern of rinse water as it flowed off the stainless steel panel after this procedure was then observed. Complete water sheeting indicated a clean surface. Breaks in the water sheet (hydrophobic areas) indicated soil remains on the panel.

The performance of the non-chlorinated experimental cleaners from Table I was compared to that of chlorinated "INTEREST" cleaner available from Diversey Corporation in Wyandotte, Mich., at 0.4% concentration. At this concentration chlorine is present at approximately 100–120 ppm. If the experimental cleaner performed as well as the chlorinated cleaner, it was deemed effective.

The following table, Table 2, illustrates the cleaners tested, the concentration of enzyme slurry therein, the temperatures, and whether the cleaner was effective in the water sheeting test for removing milk soils from stainless steel panels.

TABLE 2

(RESULTS OF STATIC CLEANING TESTS)

| % v/v Cleaner | Enzyme slurry[1] ppm | °C. | EFFECTIVE CLEANER* |
|---|---|---|---|
| — | 20 | 60 | NO |
| 0.4% Cleaner 1 | 20 | 60 | YES |
| 0.4% Cleaner 2 | 20 | 60 | YES |
| 0.4% Cleaner 2 | 0 | 60 | NO |
| 0.4% Cleaner 3 | 20 | 60 | YES |
| 0.4% Cleaner 3 | 0 | 60 | NO |
| 0.4% Cleaner 4 | 0 | 65 | NO |
| 0.4% Cleaner 5 | 20 | 60 | YES |

[1]A suspension of a protease in polyethoxylated secondary fatty alcohol sold commercially by NOVO Laboratories under the name ESPERASE 8.0 SL.
*(EFFECTIVE = performs as well as chlorinated alkalies)

A review of the data from Table 2 shows that while a 20 ppm aqueous solution of the enzyme slurry alone is not as effective as the chlorinated cleaner, and while 0.4% solutions of the cleaning compositions from Table 1 alone are not as effective as the chlorinated cleaner, the combination of a 0.4% solution of one of the cleaners from Table 1 with 20 ppm in solution of the enzyme slurry produces a cleaner which matches the performance of the chlorinated cleaner without requiring a complicated enzyme stabilizing system.

Having, thus, described the invention, what is claimed is:

1. A two-part cleaning system, for use in preparing a dilute use solution, comprising:

(a) a first concentrated solution comprising:
  (1) a hydroxide-based alkaline material,
  (2) a defoamer;
  (3) a solubilizer or emulsifier;
  (4) a water hardness control additive; and (b) a second concentrated solution in which free water is substantially absent, comprising:
  (1) an enzyme which is a protease; and
  (2) a carrier which is selected from the group consisting of alcohols, surfactants, polyols, glycols, and mixtures thereof.

2. The system of claim 1, wherein the alkaline material is present in an amount ranging from about 2.5 to about 7.5% by weight, based on the total weight of the first concentrated solution.

3. The system of claim 1, wherein the defoamer is present in an amount ranging from about 0.5 to about 5% by weight, based on the total weight of the first concentrated solution.

4. The system of claim 1, wherein the solubilizer or emulsifier is present in an amount ranging from about 1 to about 6% by weight, based on the total weight of the first concentrated solution.

5. The system of claim 1, wherein the water hardness control additive is present in an amount ranging from about 0 to 16% by weight, based on the total weight of the first concentrated solution.

6. A two part cleaning system for use in preparing a dilute use solution, comprising:

(a) a first concentrated solution, comprising:
  (1) a hydroxide-based alkaline material which is present in an amount ranging from about 2.5 to about 7.5% by weight, based on the total weight of the first concentrated solution;
  (2) a polyoxyalkylene nonionic surfactant defoamer which is present in an amount ranging from about 0.5 to about 5% by weight, based on the total weight of the first concentrated solution;
  (3) a solubilizer or emulsifier selected from the group consisting of alkaline stable amphoteric surfactants, phosphate esters, fatty acids; modified polycarboxylate compounds, and mixtures thereof, the solubilizer or emulsifier being present in an amount ranging from about 1 to about 6%, by weight, based on the total weight of the first concentrated solution;
  (4) a water hardness control additive selected from the group consisting of phosphates, sodium ethylene diamine tetraacetic acid, polyacrylic acids, mixtures of polyacrylic acid and a salt of polyacrylic acid, and mixtures thereof, the water hardness control additive being present in an amount ranging from about 0 to about 16%, by weight based on the total weight of the first concentrated solution; and (b) a second concentrated solution in which free water is substantially absent, consisting essentially of:
  (1) an enzyme which is a protease, the enzyme being present in at least 10 ppm;
  (2) a carrier, selected from the group consisting of alcohols, surfactants, polyols, glycols, and mixtures thereof.

* * * * *